US006403136B1

(12) United States Patent
Damm Bokobza

(10) Patent No.: US 6,403,136 B1
(45) Date of Patent: Jun. 11, 2002

(54) SALT AND SUGAR DISTRIBUTOR

(76) Inventor: Tanya Damm Bokobza, 9 Shikun Banim, Moshav Kfar Mordechai 76854 (IL)

( * ) Notice: Subject to any disclaimer, the term of this patent is extended or adjusted under 35 U.S.C. 154(b) by 0 days.

(21) Appl. No.: 09/487,428

(22) Filed: Jan. 19, 2000

(51) Int. Cl.[7] ..... B65D 83/00; B65D 73/00

(52) U.S. Cl. ..... 426/420; 426/132; 426/396; 426/665; 206/460

(58) Field of Search ..... 426/115, 132, 426/112, 420, 649, 396, 665; 206/460; 118/13

(56) References Cited

U.S. PATENT DOCUMENTS

| | | | | | |
|---|---|---|---|---|---|
| 1,638,480 | A | * | 8/1927 | Feybusch | 426/132 |
| 1,889,882 | A | * | 12/1932 | Woods | 426/112 |
| 1,983,685 | A | * | 12/1934 | Townsley | 426/112 |
| 2,647,681 | A | * | 8/1953 | Paoli | 426/115 |
| 2,759,830 | A | * | 8/1956 | Touceda | 426/132 |
| 2,895,606 | A | * | 7/1959 | Hoag | 426/115 |
| 2,956,710 | A | * | 10/1960 | Oconnor | 426/115 |
| 3,126,284 | A | * | 3/1964 | Howerin | 426/132 |
| 3,252,803 | A | * | 5/1966 | Belasco | 426/132 |
| 3,263,863 | A | * | 8/1966 | Hoag | 426/115 |
| 3,366,229 | A | * | 1/1968 | Sanni | 426/115 |
| 3,413,128 | A | * | 11/1968 | Steinbarth et al. | 426/115 |
| 3,473,650 | A | * | 10/1969 | Hoag | 426/115 |
| 3,526,316 | A | * | 9/1970 | Kalogris | 426/420 |
| 3,689,291 | A | * | 9/1972 | Draper | 426/113 |
| 3,730,737 | A | * | 5/1973 | Harvey et al. | 426/112 |
| 3,740,239 | A | * | 6/1973 | Chancellor | 426/115 |
| 4,061,783 | A | * | 12/1977 | Hoffman et al. | 426/115 |
| 4,816,268 | A | * | 3/1989 | Tsau | 426/132 |
| 5,705,214 | A | * | 1/1998 | Ito et al. | 426/132 |
| 5,922,377 | A | * | 7/1999 | Nordstrom | 426/132 |

FOREIGN PATENT DOCUMENTS

| | | | | |
|---|---|---|---|---|
| AU | 7815/27 | * | 6/1927 | 206/460 |
| EP | 408164 | * | 1/1991 | 426/132 |
| GB | 721455 | * | 1/1955 | 426/115 |

* cited by examiner

*Primary Examiner*—Steven Weinstein
(74) *Attorney, Agent, or Firm*—Ladas & Parry

(57) ABSTRACT

A dispenser for a granular foodstuff including web material, and a granular foodstuff removably adhered to at least one surface of the web material, whereby frictional engagement between two adjacent surfaces of the web material causes disengagement of the foodstuff from the web material and provides controlled dispensing thereof.

10 Claims, 2 Drawing Sheets

SALT
12
30

32
34

60°C 34
32
36
SALT
32
34
32

SALT AND SUGAR DISTRIBUTOR

FIELD OF THE INVENTION

The present invention relates to dispensing of foodstuffs, such as salt and sugar.

BACKGROUND OF THE INVENTION

Various techniques are known for dispensing of foodstuffs, such as salt and sugar. Salt shakers and grinders are well known as are various types of sugar dispensers.

Condiments such as salt and pepper as well as sugar are also available in tearable packets for the food service industry. Unfortunately, the use of such packets does not provide the user with a convenient way of controlling the amount of the condiment that is being dispensed.

SUMMARY OF THE INVENTION

The present invention seeks to provide an improved dispenser for granular foodstuffs, such as salt and sugar.

There is thus provided in accordance with a preferred embodiment of the present invention a dispenser for a granular foodstuff including web material and a granular foodstuff removably adhered to at least one surface of the web material, whereby frictional engagement between two adjacent surfaces of the web material causes disengagement of the foodstuff from the web material and provides controlled dispensing thereof.

There is also provided in accordance with a preferred embodiment of the present invention a method for dispensing a granular foodstuff including the steps of:

adhering a granular foodstuff to at least one surface of a web material; and causing frictional engagement between two facing portions of the at least one surface thereby to produce disengagement of the foodstuff from the web material and controlled dispensing thereof.

The granular foodstuff may be adhered to the web material by means of an adhesive. Alternatively it may be adhered to the web material other than by means of an adhesive.

Preferably, the granular foodstuff is adhered to only one surface of the web material, whereby the web material may be held and manipulated by a user without engaging the granular foodstuff.

The granular foodstuff may be any suitable granular foodstuff, such as salt, ground pepper and sugar.

The web material may include paper or any other suitable web material, such as a non-woven material.

Preferably the web material is folded over or is otherwise provided in two adjacent sheets, such that the granular foodstuff adhered thereto lies on opposite facing inside surfaces thereof.

In accordance with a preferred embodiment of the present invention, the two adjacent sheets are sealed peripherally of the granular foodstuff in order to preserve the integrity thereof.

BRIEF DESCRIPTION OF THE DRAWINGS

The present invention will be understood and appreciated more fully from the following detailed description, taken in conjunction with the drawings in which.

DETAILED DESCRIPTION OF A PREFERRED EMBODIMENT

Figure 1:
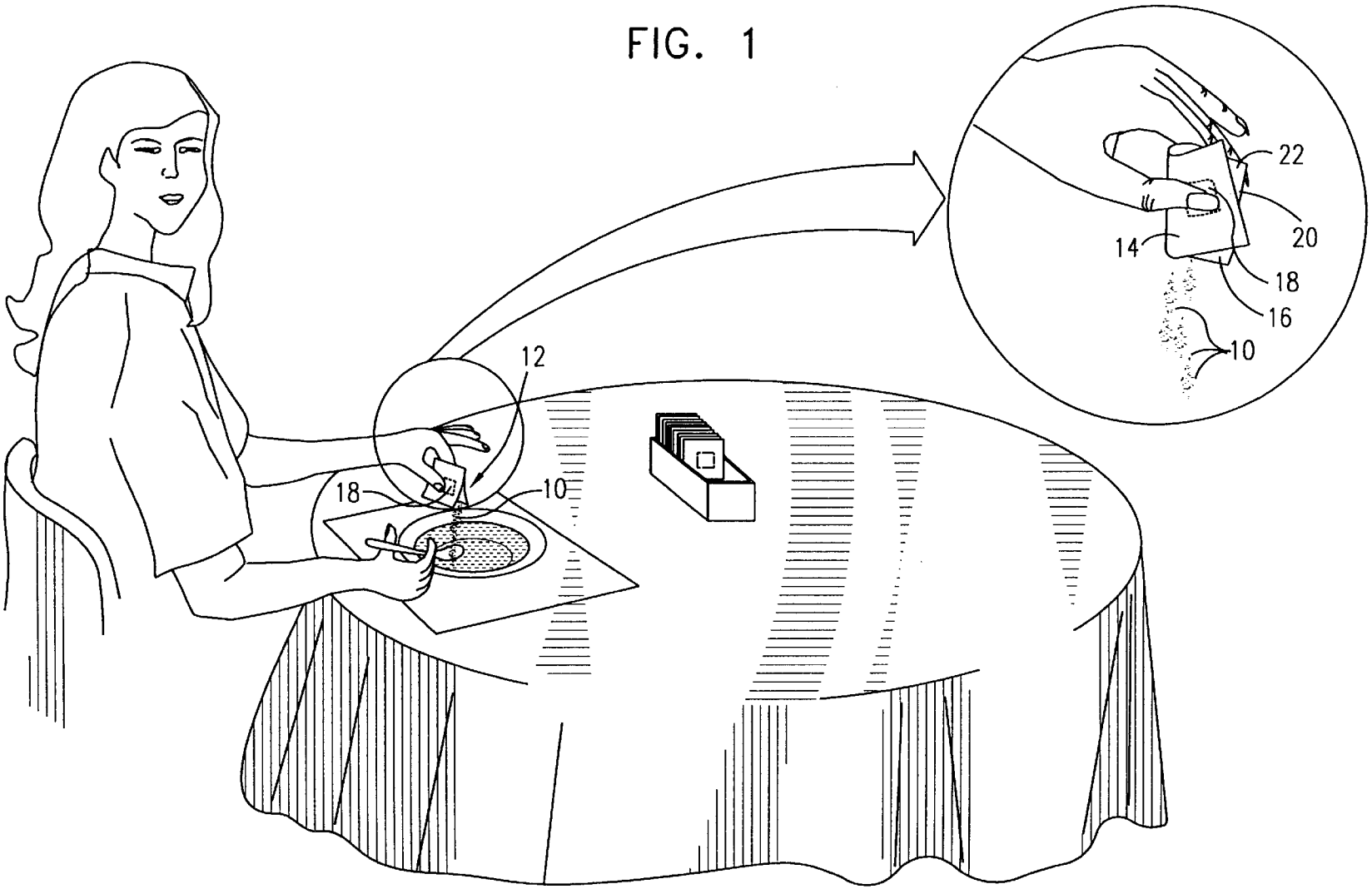
FIG. 1 is a pictorial illustration of dispensing of a granular foodstuff in accordance with a preferred embodiment of the present invention.
Figures 2A, 2B, 2C, 2D, 2E, 2F:
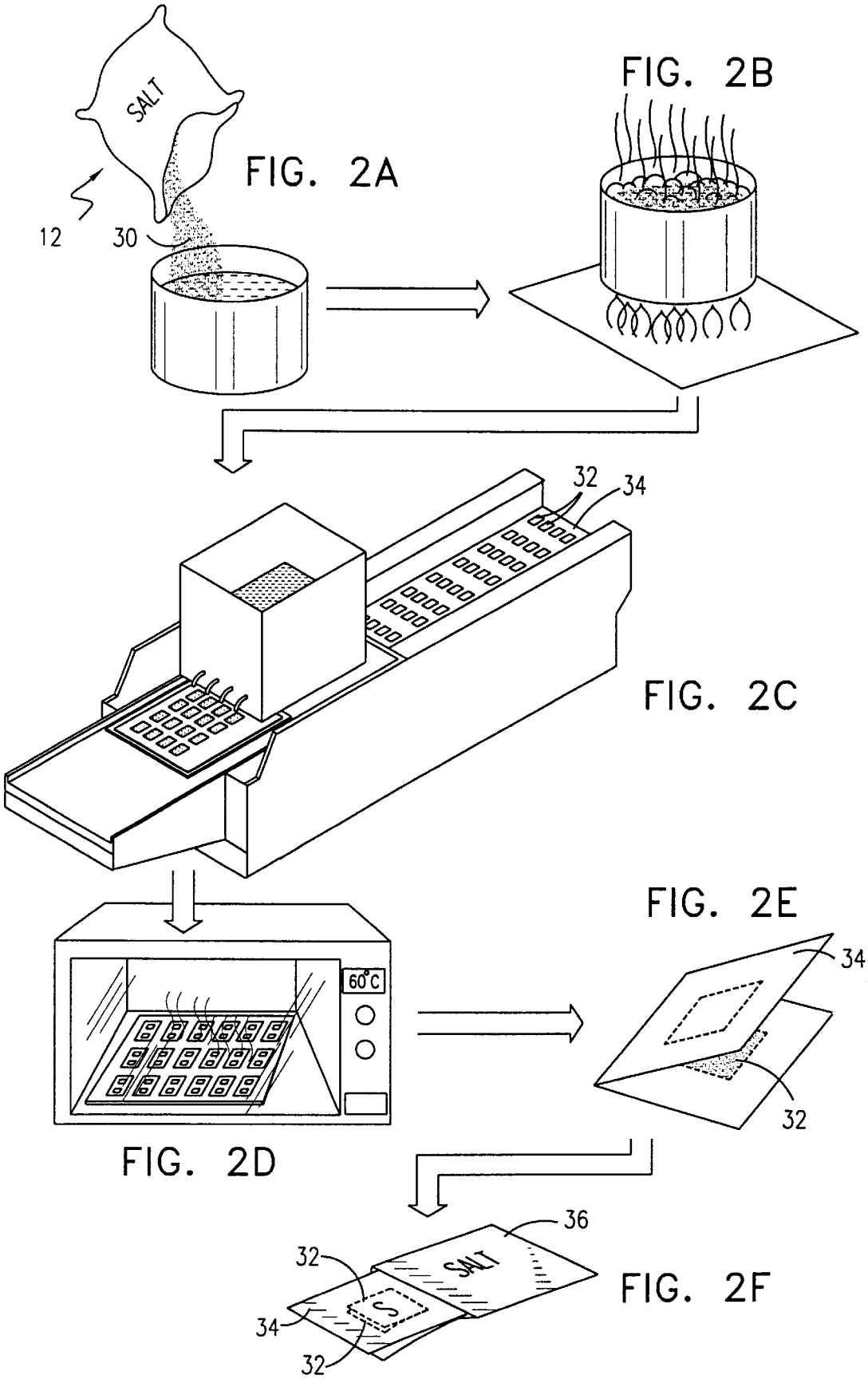
FIGS. 2A–2F are pictorial illustrations of the preparation of granular foodstuff dispensers in accordance with a preferred embodiment of the present invention.

Reference is now made to FIG. 1, which is a pictorial illustration of dispensing of a granular foodstuff in accordance with a preferred embodiment of the present invention.

As shown in FIG. 1, a user is shown dispensing a granular foodstuff, such as salt 10 by manipulating a dispenser 12, preferably between the user's thumb and forefinger. The dispenser 12 preferably comprises two plies 14 and 16 of web material, such as paper, onto which is adhered a granular foodstuff, such as salt 10. In the illustrated embodiment of the present invention, the granular foodstuff is adhered to one of two inwardly facing surfaces 18 and 20 of a folded over piece of web material 22, which define plies 14 and 16.

By manipulating the two plies 14 and 16, the user causes the granular foodstuff to be rubbed off of the surface or surfaces 18 and 20 onto which it was adhered. This technique provides highly controllable dispensing of the granular foodstuff.

Reference is now made to FIGS. 2A–2F which illustrate in simplified form a technique for producing a dispenser 12 of the type shown in FIG. 1. As seen in FIG. 1, salt 30 is preferably dissolved in water and then deposited at deposit regions 32 on a surface of web material 34. The web material 34 having the salt water deposited at regions 32 thereon is then preferably heated to evaporate the water therefrom. Each piece of web material 34 is then preferably folded over, such that deposit regions 32 are generally in facing juxtaposition with each other. The web material 34 may then be enclosed within an outer wrapper 36, as shown, or sealed peripherally of regions 32.

It is appreciated that alternatively, any acceptable adhesive may be used to adhere the foodstuff to the web material 34. It is also appreciated that the web material need not be folded over initially and that two separate sheets of web material may be provided to define deposit regions which face each other.

It will be appreciated by persons skilled in the art that the present invention is not limited to what has been particularly shown and described hereinabove. Rather the present invention includes both combinations and subcombinations of various features described hereinabove as well as modifications and variations thereof which would occur to a person skilled in the art upon reading the foregoing description and which are not in the prior art.

What is claimed is:

1. A method for controlled dispensing of a granular: foodstuff comprising the steps of:

adhering a granular foodstuff to at least one surface of a web material such that contacting frictional engagement between two surfaces of the web material produced by manipulation of the two surfaces by a user's fingers causes disengagement of the foodstuff from the web material and provides controlled dispensing thereof;

bringing said at least one surface into contact with at least another surface of said web material; and controlled dispensing of said granular foodstuff by manipulating said surfaces between the user's fingers and causing frictional engagement between two facing surface positions of said web material producing disengagement of the foodstuff from the web material and controlled dispensing thereof.

2. A method according to claim 1 and wherein said granular foodstuff is adhered to said web material by means of an adhesive.

3. A method according to claim 1 and wherein said granular foodstuff is adhered to said web material other than by means of an adhesive.

4. A method according to claim 1 and wherein said granular foodstuff is adhered to only one surface of said web material and wherein the step of causing is carried out by a user who holds and manipulates the web material without engaging said granular foodstuff.

5. A method according to claim 1 and wherein said granular foodstuff comprises salt.

6. A method according to claim 1 and wherein said granular foodstuff comprises sugar.

7. A method according to claim 1 and wherein said granular foodstuff comprises pepper.

8. A method according to claim 1 and wherein said web material comprises paper.

9. A method according to claim 1 and also comprising:

folding said web material to define said two facing surface portions.

10. A method according to claim 1 and also comprising:

enclosing said web material within an outer wrapper following adhering of said granular foodstuff to at least one surface of said web material.

* * * * *